US005758779A

United States Patent [19]

Atkins

[11] Patent Number: 5,758,779

[45] Date of Patent: Jun. 2, 1998

[54] BRIM FORMING CAP HOLDER

[76] Inventor: Charlie C. Atkins, 8616 W. 45th Pl., Lyons, Ill. 60534

[21] Appl. No.: 852,426

[22] Filed: May 7, 1997

[51] Int. Cl.[6] ..... A47F 7/00

[52] U.S. Cl. ..... 211/32; 211/30

[58] Field of Search ..... 211/32, 14, 13.1, 211/30, 71.01

[56] References Cited

U.S. PATENT DOCUMENTS

| | | | |
|---|---|---|---|
| 2,937,759 | 5/1960 | Smith | 211/32 |
| 3,737,081 | 6/1973 | James | 223/84 |
| 3,858,769 | 1/1975 | Billingslea | 223/84 |
| 4,993,557 | 2/1991 | Davis | 211/30 |
| 5,086,931 | 2/1992 | Cobb | 211/32 |
| 5,203,462 | 4/1993 | Brooks | 211/14 |
| 5,224,102 | 6/1993 | Koenig | 211/32 |
| 5,480,073 | 1/1996 | LaManna | 223/1 |
| 5,683,002 | 11/1997 | Rayside | 211/32 X |

*Primary Examiner*—Alvin C. Chin-Shue
*Assistant Examiner*—Sarah Purol
*Attorney, Agent, or Firm*—Don Moyer

[57] ABSTRACT

The cap holder has a back which can be hung on a vertical surface, has a lip protruding downward and away from the back, and has apertures in the lip for holding a cap, with the cap crown mainly open so that the cap can air out, with markings on the cap crown in a display position, and with the cap brim in a rolled configuration so that the cap brim will be formed into a rolled state which is set and persists when the cap is worn. Pegs for holding garments are also attached to the back.

9 Claims, 1 Drawing Sheet

FIG. 1
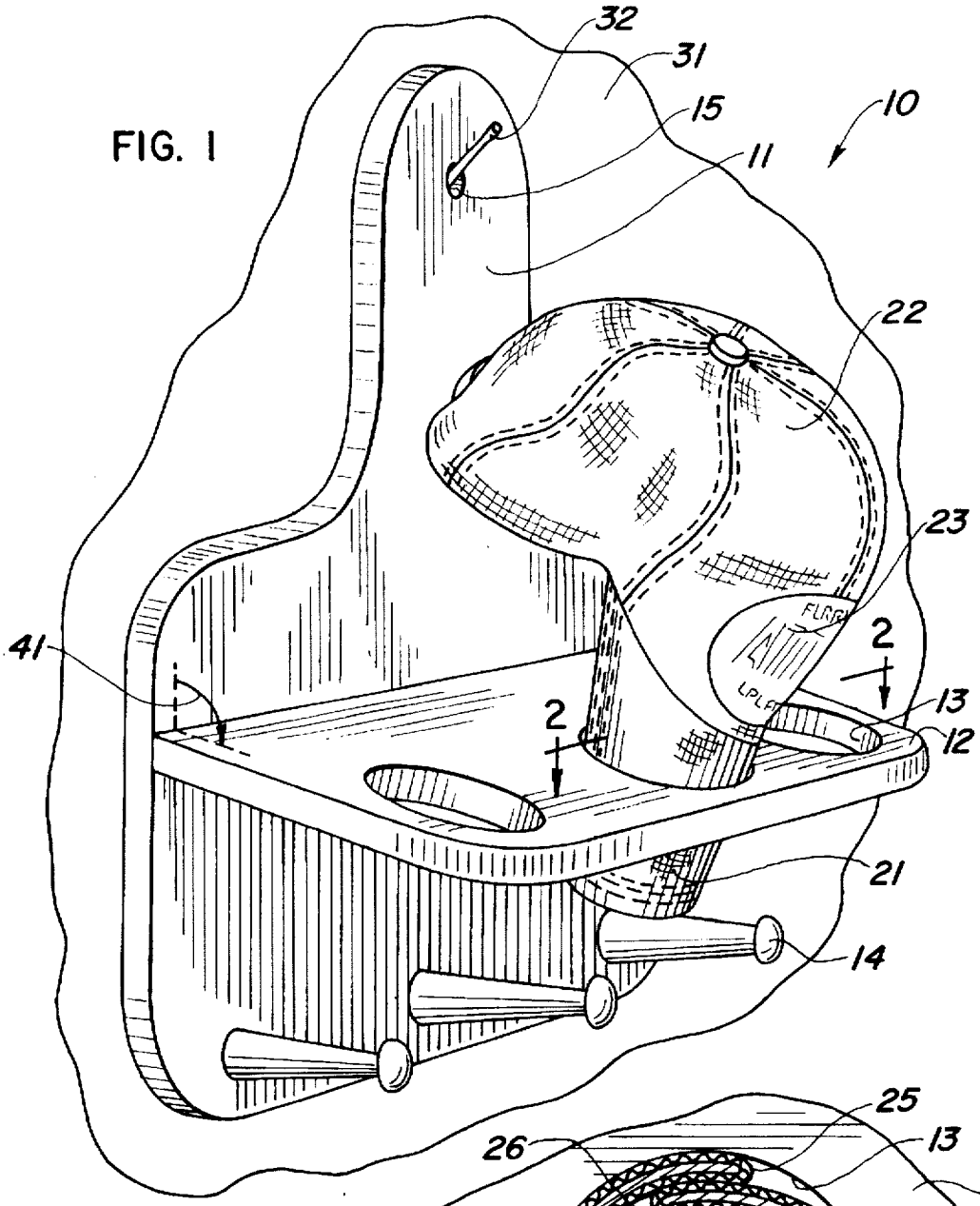
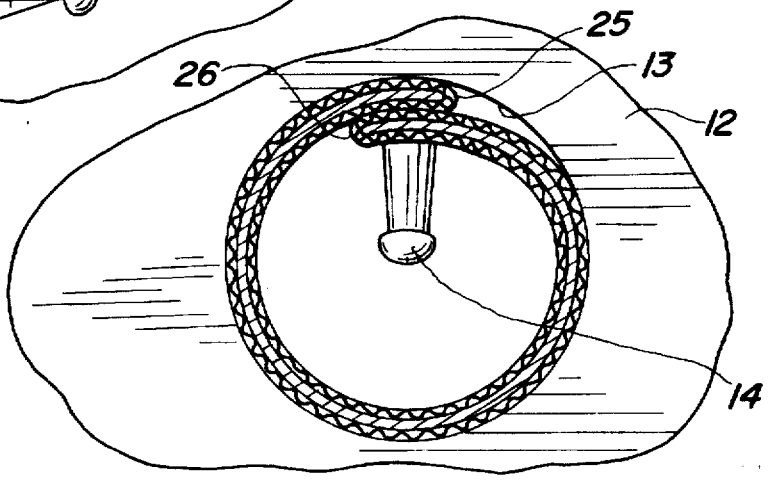
FIG. 2

BRIM FORMING CAP HOLDER

RELATED APPLICATIONS

NOT APPLICABLE

FEDERAL SPONSOR

NOT APPLICABLE

MICROFICHE APPENDIX

NOT APPLICABLE

BACKGROUND

The invention is a holder for baseball style caps which holds the brim in a rolled configuration in order to form the brim into a rolled state which is set and persists when the cap is worn.

Baseball type caps are popular and there are a number of products which are intended to be of use to people who wear and collect these caps. For example, holders which hold several of these caps are available. Many people who wear these caps prefer to form the brim of their cap into a rolled state with a radius of curvature considerably smaller than that of a new cap. A product to aid forming the brim to this rolled state has not been disclosed, nor has a product which will both hold these caps and aid in forming the preferred rolled state been disclosed until now.

Devices for forming the brim of a western style hat are shown in prior art, for example by James in U.S. Pat. No. 3,737,081 and by Billingslea in U.S. Pat. No. 3,858,769. These devices form a rolled state which is not the rolled state desired by wearers of baseball style caps, and these devices can not be adapted to hold baseball style caps in a position which displays markings on the front of the crown of baseball style caps which is also desired by owners of baseball style caps.

Various devices for holding baseball style caps are shown in prior art. Davis in U.S. Pat. No. 4,993,557 shows a device for stacking the caps which has no means for forming the brim, displays the crown markings upward, and stacks the caps with the crowns folded closed so that they will not air out while stacked. In U.S. Pat. No. 5,224,102 Koenig shows a device which holds caps without any forming of the brim. The crowns are folded shut so that they will not air out while held. Because the crowns are folded shut the display of crown markings is limited in this device. LaManna in U.S. Pat. No. 5,480,073 shows a holder which maintains the brim in its normal shape and which holds the caps with crown markings toward a vertical surface.

Thus there is need for a cap holder which will form the brim into a rolled state while holding the cap in a position which displays the crown markings and allows the crown to air out as the cap is held.

SUMMARY

Objects of this invention comprise requirements listed in the following imperatives. Make a device which will hold baseball style caps. Make a cap holder which will form the cap brim into a rolled state. Make a brim forming cap holder which will hold the cap with any markings on the front of the cap crown displayed. Make a displaying and brim forming cap holder which will hold the crown generally open so that the crown can air out while the cap is held. Make this holder occupy a small space. Provide this holder with pegs for holding various garments. Make this holder have low cost and be reliable, easy to manufacture, and easy to use.

Other objects will be comprehended in the drawings and detailed description, which will make additional objects obvious hereafter to persons skilled in the art.

In summary one embodiment of this brim forming cap holder has a back hangable on a vertical surface and has a lip attached to the back so that the lip slopes downward as it extends away from the back, has at least one aperture in the lip through which the brim of a baseball style cap can be held with the brim being held in a rolled configuration for forming the brim into a rolled state.

Other equivalent embodiments will be comprehended in the drawings and detailed description, which will make additional equivalent embodiments obvious hereafter to persons skilled in the art.

DRAWINGS

In the drawings:

FIG. 1 shows the brim forming cap holder in use holding a cap.

FIG. 2 is a view looking across 2—2 in FIG. 1 showing the rolled configuration of the cap in the holder.

DETAILED DESCRIPTION

The brim forming cap holder 10 is shown in use in FIG. 1. The holder has a back 11 which has a mounting device so that the back can hang on a vertical surface 31. The mounting device shown is a mounting hole 15 supported by a pin 32, but any other equivalent mounting device can be used. The holder can be hung on various vertical surfaces such as a wall and a door.

A lip 12 is attached to the back so that the lip slopes downward as it protrudes away from the back. There are three apertures 13 through the lip. There could be less, and there could be more. Three are preferred in order to give the holder pleasing proportions. A cap brim 21 is shown in one of the apertures held in a rolled configuration. The preferred diameter for the apertures is two and one half inches. This means that the rolled configuration of a typical cap brim entails some overlap of the opposing edges 25 and 26 of the cap brim as is shown in FIG. 2.

The brim of a new cap has a very large radius of curvature and is nearly planar, but many wearers of these caps prefer that the brim be formed into a rolled state with a smaller radius of curvature. When a cap is held in this holder in the rolled configuration, then the brim is formed over time into a desired rolled state. Over time a rolled state becomes set and persists when the cap is not in the holder and is being worn by a person. The rolled configuration—and thus the rolled state—can be varied somewhat by varying the depth to which the cap brim is inserted into an aperture 13 to be held.

The lip slopes downward away from the back—making the angle 41 between the back and the lip greater than ninety degrees—for several reasons. This allows the cap crown 22 to be mainly open when the cap is held so that the cap can air out. This also keeps cap markings 23 in a position in which they are clearly displayed which is desired by people who wear and collect these caps. The angled lip provides these functions without taking as much horizontal space as a horizontal lip would take. The angled lip provides these functions without being as large as a horizontal lip would have to be. And, the angled lip discourages use of the lip as a shelf for stowing other objects which might detract from the pleasing appearance of the holder.

The preferred form of the holder also has pegs 14 attached to the back below the lip. These pegs can be used to hold various garments and increase the usefulness—and pleasing appearance—of the holder. Other additions and other decorative forms for the back, the lip, and the pegs will be obvious hereafter to people skilled in the art.

Other equivalent forms for the back, the lip, and the apertures and other equivalent means for holding the brim in a rolled configuration for forming cap brims into a set rolled state will be obvious hereafter to persons skilled in the art. Therefore this invention is not limited to the particular examples shown and described here.

I claim:

1. A cap holder comprising:

a back, the back being hangable on a vertical surface;

a lip having a rear edge and a front edge, the lip being attached to the back, and the lip protruding away from the back; and an aperture through the lip spaced from the rear edge and proximate the front edge of the lip, the aperture for holding a cap brim in a rolled configuration, the rolled configuration for forming the brim into a rolled state which is set and persists when the cap is not in the aperture.

2. The cap holder of claim 1 wherein the lip slopes downward as it protrudes away from the back.

3. The cap holder of claim 1 further comprising pegs attached to the back, the pegs for holding garments.

4. The cap holder of claim 1 further comprising a mounting hole through the back, the mounting hole for hanging the back on a pin attached to the vertical surface.

5. A cap holder comprising:

a back, the back being hangable on a vertical surface;

a lip, the lip being attached to the back, the lip protruding away from the back, and the lip sloping downward as the lip protrudes away from the back; and an aperture through the lip, the aperture for holding a cap brim in a rolled configuration, the rolled configuration for forming the brim into a rolled state which is set and persists when the cap is not in the aperture.

6. The cap holder of claim 5 further comprising pegs attached to the back, the pegs for holding garments.

7. The cap holder of claim 5 further comprising a mounting hole through the back, the mounting hole for hanging the back on a pin attached to the vertical surface.

8. A cap holder comprising:

a back, the back being hangable on a vertical surface; a lip, the lip being attached to the back, the lip protruding away from the back, and the lip sloping downward as the lip protrudes away from the back;

an aperture through the lip, the aperture for holding a cap brim in a rolled configuration, the rolled configuration for forming the brim into a rolled state which is set and persists when the cap is not in the aperture; and pegs attached to the back, the pegs for holding garments.

9. The cap holder of claim 8 further comprising a mounting hole through the back, the mounting hole for hanging the back on a pin attached to the vertical surface.

* * * * *